US006523725B1

(12) United States Patent
Paczkowski et al.

(10) Patent No.: US 6,523,725 B1
(45) Date of Patent: Feb. 25, 2003

(54) CAP STOP DIVIDER FOR VENDING MACHINE STORAGE COMPARTMENTS

(75) Inventors: Thomas S. Paczkowski, Wildwood, MO (US); Steve Zychinski, St. Louis, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 41 days.

(21) Appl. No.: 09/717,405

(22) Filed: Nov. 21, 2000

(51) Int. Cl.[7] ..... B65H 31/20
(52) U.S. Cl. ..... 222/241; 312/45
(58) Field of Search ..... 221/67, 241, 197, 221/114, 92, 124; 312/45, 42, 72; 211/59.1

(56) References Cited

U.S. PATENT DOCUMENTS 2,836,326 A * 5/1958 Childers ..... 221/67
3,026,002 A 3/1962 Torres ..... 221/67
4,460,107 A 7/1984 Lindsey ..... 221/67
4,940,161 A 7/1990 Hieb ..... 221/67
4,986,615 A 1/1991 Hieb et al. ..... 312/45
4,991,739 A 2/1991 Levasseur ..... 221/114
4,991,740 A 2/1991 Levasseur ..... 221/114
5,529,207 A * 6/1996 Oden et al. ..... 221/67
6,302,293 B1 * 10/2001 Wittern, Jr. et al. ..... 221/92

* cited by examiner

*Primary Examiner*—Kenneth W. Noland
(74) *Attorney, Agent, or Firm*—Polster, Lieder, Woodruff & Lucchesi, L.C.

(57) ABSTRACT

This retainer system for vending machine compartment includes a divider having a base member attached to a wall and a cap stop member attached to the base member by a hook and slot arrangement which permits the cap member to be pulled out from a retracted to an extended position in which it is engageable by the cap end of a bottle to provide a stop inhibiting longitudinal migration of the bottle.

10 Claims, 6 Drawing Sheets

CAP STOP DIVIDER FOR VENDING MACHINE STORAGE COMPARTMENTS

BACKGROUND OF THE INVENTION:

This invention relates generally to a retainer system for vending machine compartments and in particular to a divider assembly which includes a pull-out member that is stored in a retracted position when the compartment is being loaded and may be pulled out to an extended position to engage a bottle cap to prevent forward migration of the bottles when the compartment is loaded.

When vending machines of the type under consideration were first introduced, they were intended primarily to vend soft drink products in 12 ounce cans. Such cans have a very stable geometry and rarely created a vend reliability problem.

With the advent of larger size plastic containers into the marketplace, for example, 20 ounce plastic bottles, problems were presented which were not encountered with metal cans. Originally the bottles were vended in double depth columns, one in the front and one in the rear. This presented a problem of providing a retaining system which was adjustable to permit conversion from cans to bottles and this problem was solved by providing a retainer system which was engageable with the ends of the cans and also with the necks of the bottles as disclosed in commonly owned U.S. Pat. No. 5,529,207.

However, with the advent of triple depths columns additional problems were presented because of the increased depth of reach required for loading.

This problem is solved herein in a manner not revealed by the known prior art.

SUMMARY OF THE INVENTION

This vending machine storage compartment retainer system facilitates the use of triple depth columns by providing a divider between the first and second columns which include a pull-out member which is retractable during loading and is extendable to engage the bottle cap and preclude forward migration of the bottle containers after the container is loaded.

This retainer system for a vending machine storage compartment comprises a compartment wall; an elongate retainer including: a first member attached to the wall and having a portion outstanding from the wall; a second member and means for attaching the second member to the first member outstanding portion for movement from a first, retracted position to a second outwardly extended position adapted to engage and intercept a container cap.

It is an aspect of this invention to provide that the attachment means includes a cutout provided by one of said members and a tab provided by the other of said members and received by the cutout of said one member, said tab being configurated to engagingly connect said first and second members in said first and second positions.

It is another aspect of this invention to provide that said first member includes a slot cutout having a first portion, a second transverse portion disposed below said first portion and a third portion disposed below said second portion and offset from said first portion, said first and third portions communicating with said second portion; and to provide that said second member includes a tab having a forward portion and a rearward portion smaller than said forward portion whereby said tab is received by said first cutout portion, movable downwardly into engagement with said first member in said retracted position, and movable transversely in said second cutout portion maintaining engagement with said first member into said extended position.

It is still another aspect of this invention to provide that said tab forward portion extends above and below said rearward portion.

It is yet another aspect of this invention to provide that said attachment means between the first and second members is provided at two locations in spaced vertical relation.

It is another aspect of this invention to provide a retainer system for a triple depth vending machine storage compartment, the system comprising opposed compartment walls defining forward, intermediate and rear columns the forward and intermediate columns being adapted to store forwardly arranged bottles; opposed divider assemblies between the forward, and intermediate columns each assembly including: a base member attached to a compartment wall and having portion outstanding from the wall including a slot, and a cap stop member including a hook receivable by the slot in movable relation for movement of the cap stop member from a retracted position to an extended position in which the cap stop member is engageable by the cap of a bottle in the intermediate column.

This retainer system is relatively inexpensive to manufacture, simple to install and operate and is very effective for its intended purpose.

DESCRIPTION OF THE PREFERRED EMBODIMENT

Figure 1:
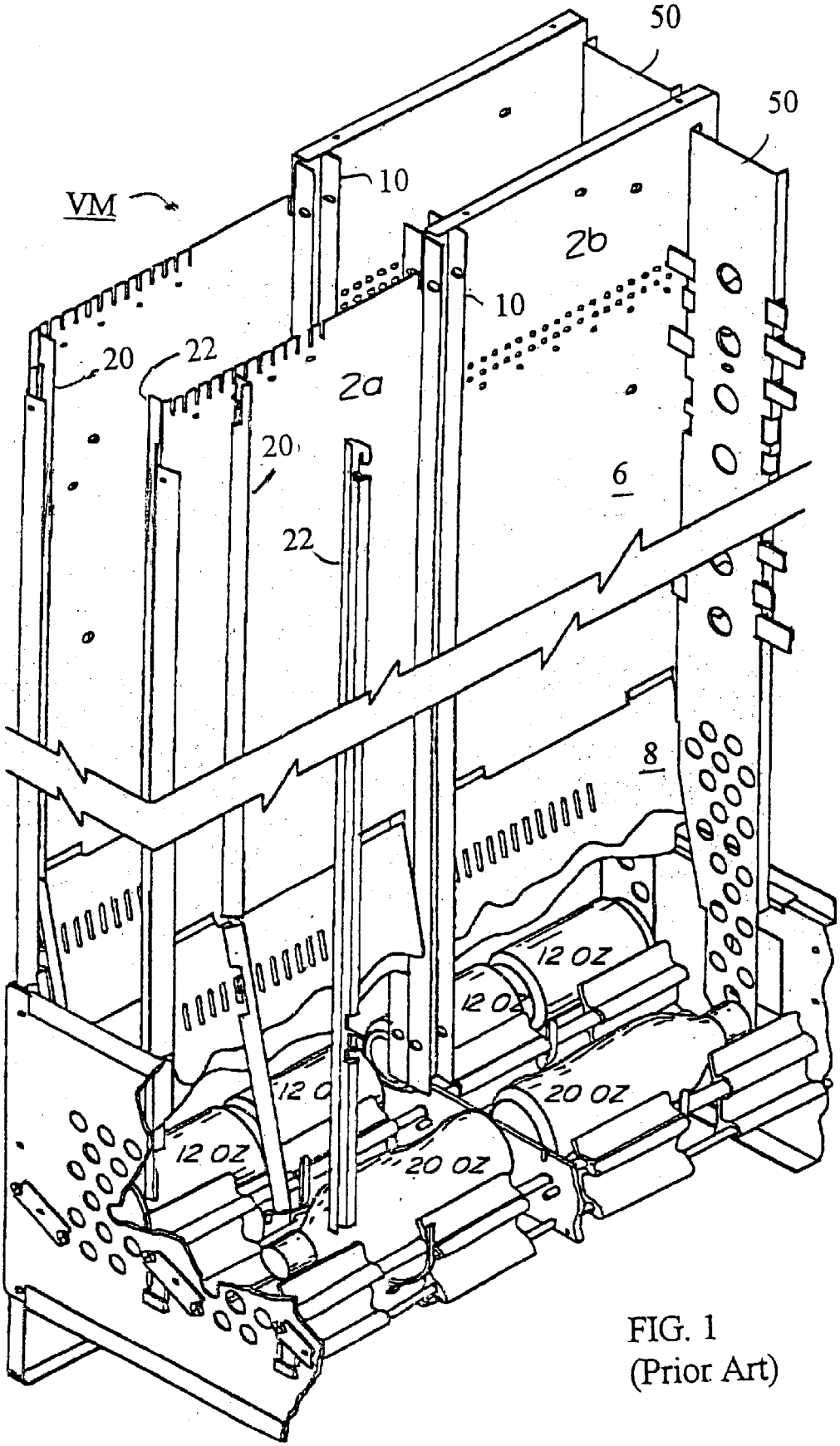
FIG. 1 (Prior Art)
FIG. 1 is a perspective view of a prior art double-depth vending machine compartment.

Referring now by reference numerals to the drawings and first to FIG. 1, it will be understood that the front and rear compartments 2*a*, 2*b* shown are parts of a prior art vending machine VM. The two compartments are provided with retainer members 20 and 22, divider members 10 and an end partition 50. Vending machine compartments of this type are shown in commonly owned U.S. Pat. No. 5,529,207, which is incorporated herein by reference.

Figure 2:
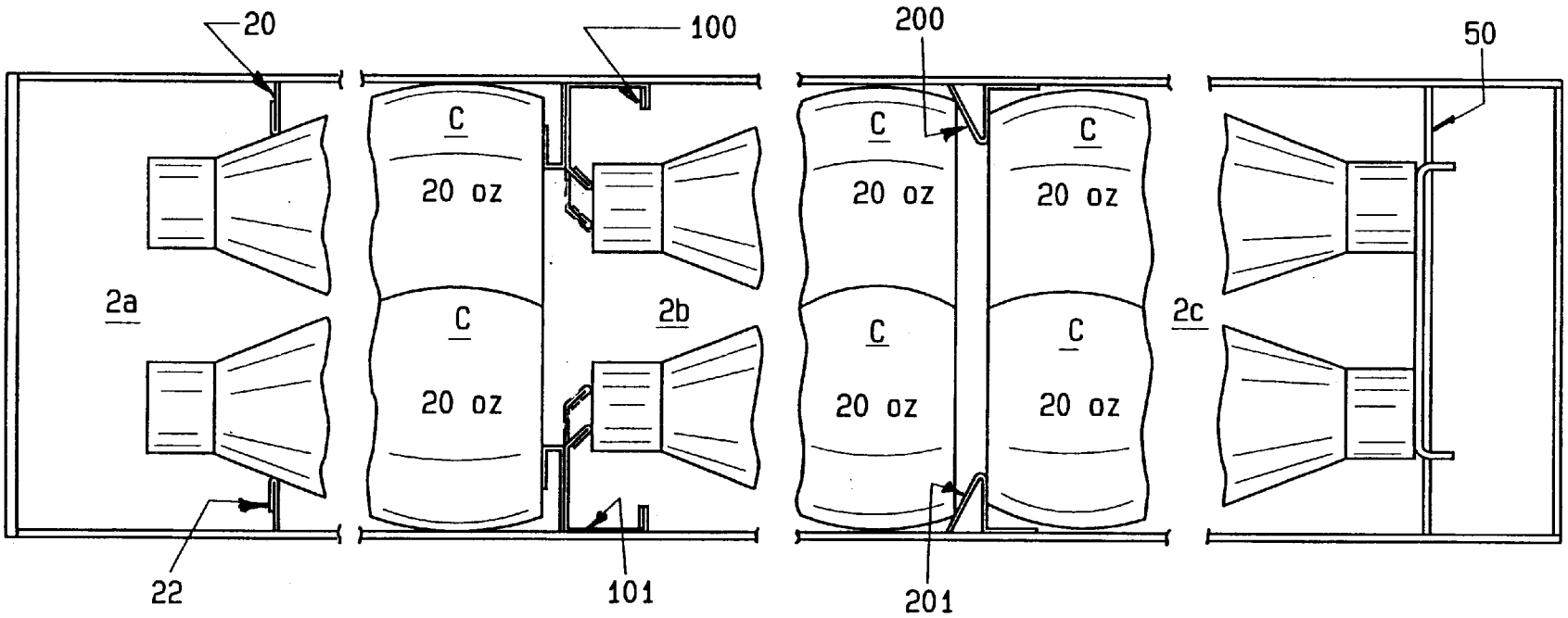
FIG. 2 is a simplified fragmentary plan view of a triple-depth compartment showing the divider assembly between the compartment first and second columns.

The present triple-depth compartment is shown in simplified form in a plan view FIG. 2 and includes opposed triple-depth compartment columns 2*a*, 2*b* and 2*c* having a divider assembly 100 separating the first and second compartment columns 2*a* and 2*b*, a retainer 200 separating the second and third compartment columns 2*b* and 2*c* and an end partition 50. The retainer 20 is disclosed and described in U.S. Pat. No. 5,529,207 which is incorporated herein by reference. The retainer 200 forms the subject matter of companion application Ser. No. 09/755,377. The end partition 50 is similar to that shown in U.S. Pat. No. 5,529,207.

Figure 3:
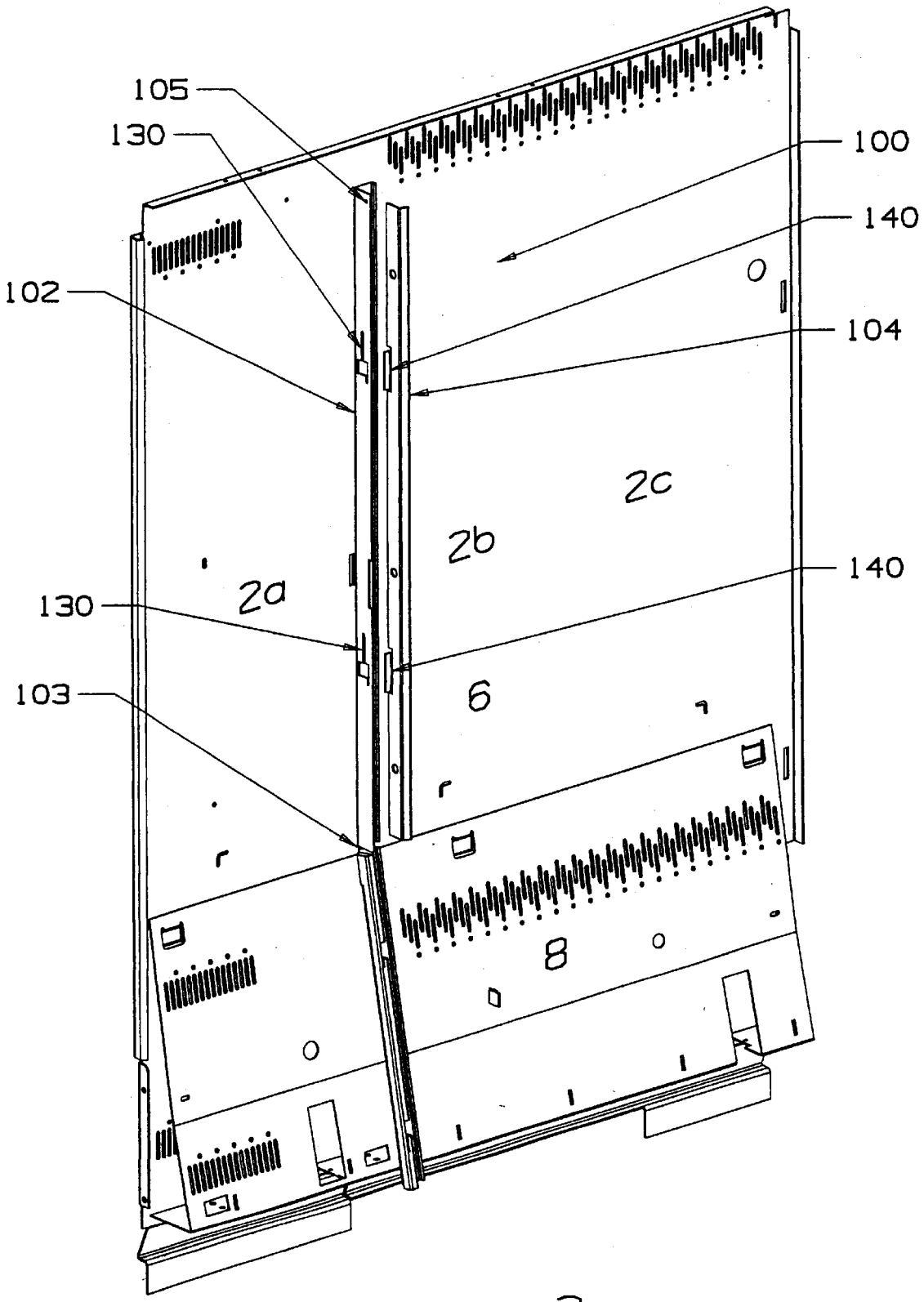
FIG. 3 is a perspective view of a compartment wall showing the divider assembly with a simplified base member and with the cap stop member in the incipient installed position.
Figure 4:
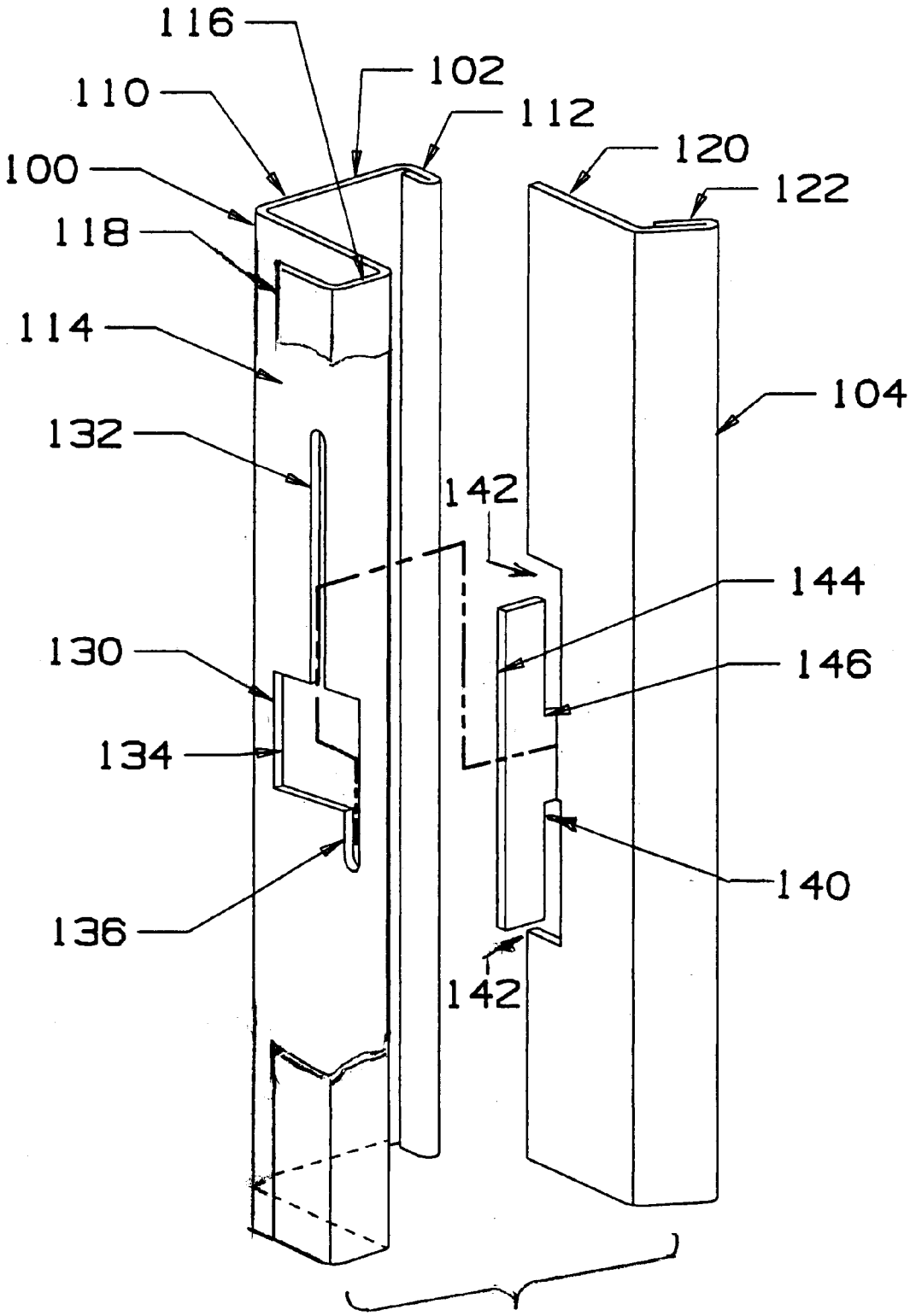
FIG. 4 is an enlarged fragmentary perspective view of the base member and cap stop member with the cap stop member in the incipient installed position.

As shown in FIGS. 2–4, the divider assembly 100 includes an elongate base member 102, constituting a first member, and an elongate cap stop member 104, constituting a second member.

More specifically, the divider assembly 100 consisting of base member 102 and cap stop member 104 are best described by reference to FIGS. 2–6. In FIG. 2, the base member 102 is shown simplified for convenience is attached to the wall 6 as by fasteners (not shown) and the cap stop member 104 is attached to the base member 102 for movement between a retracted position shown in FIG. 5 and extended position as shown in FIG. 6 by a connection system as will now be described. In the extended position, the cap stop member 104 is engageable by the cap of a bottle container C. In the retracted position, the space between the dividers 102 on opposite walls is sufficiently wide to facilitate loading.

The divider assembly base member 102 includes a wall connected portion 110, which is attached to the wall 6, a doubled back outstanding stiffener flange 112, an outstanding web 114, a reentrant flange 118 and a connecting portion 116. The cap stop member 104 includes a web portion 120 and a doubled back, inclined flange 122.

Figure 5:
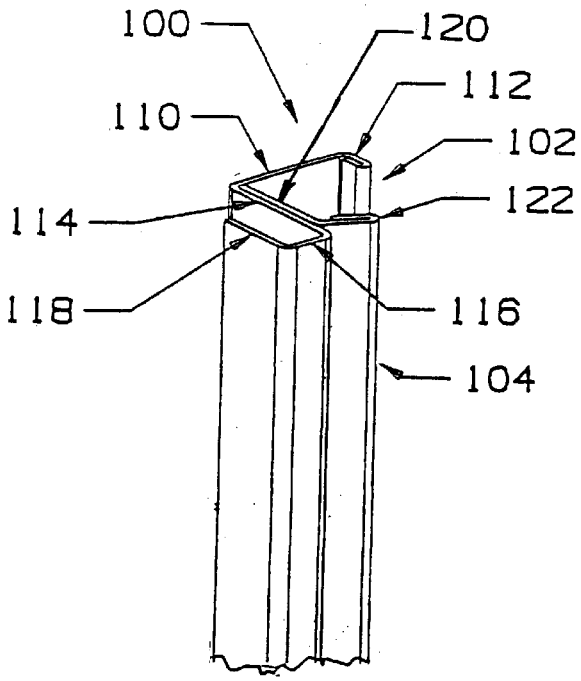
FIG. 5 is a perspective view of the divider assembly with the cap stop member in the retracted position.
Figure 6:
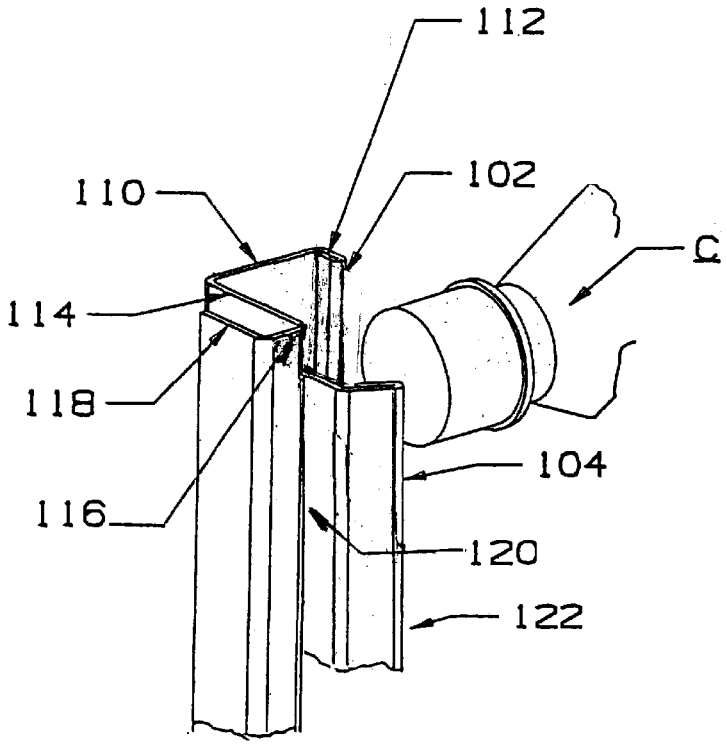
FIG. 6 is perspective view of the divider assembly with the cap stop member in the extended position and engageable with the cap of a bottle container.
Figure 8:
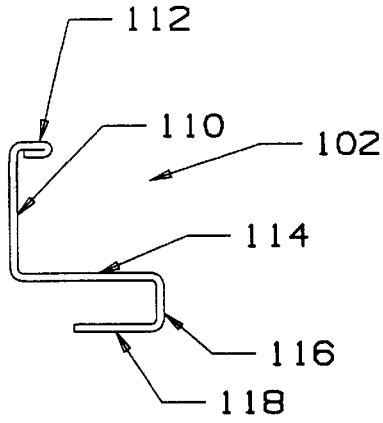
FIG. 8 is a plan view of the base member following formation.
Figure 10:
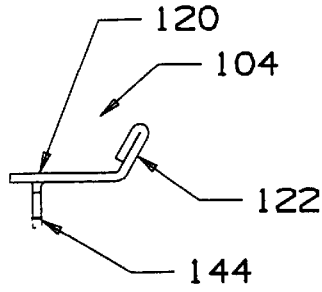
FIG. 10 is a plan view of the cap stop member following formation.
Figure 7:
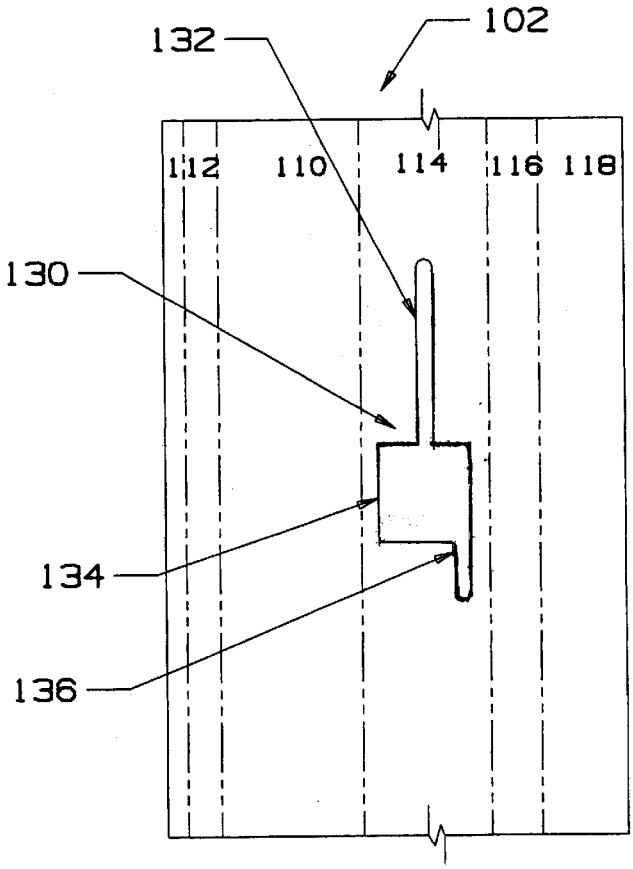
FIG. 7 is an elevational view of the sheet metal sheet forming the base member prior to formation.
Figure 9:
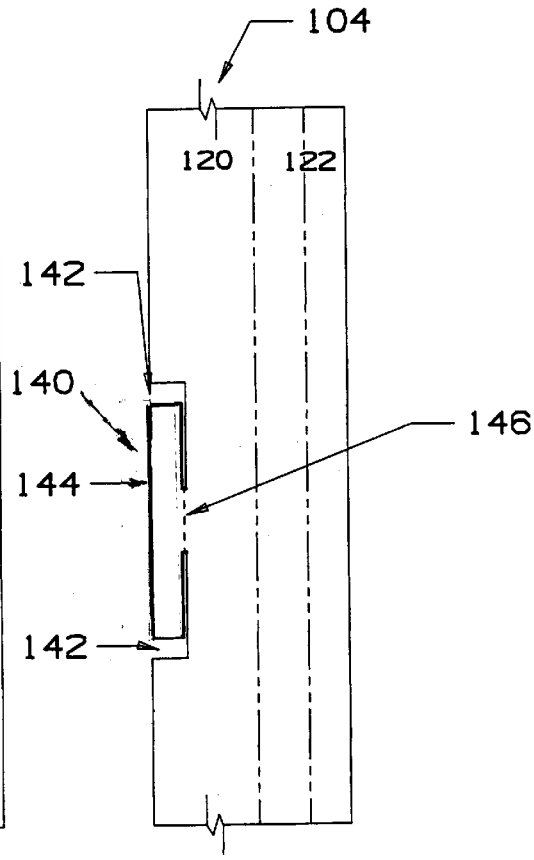
FIG. 9 is an elevational view of the sheet metal sheet forming the cap stop member prior to formation.

The cap stop member 104, as shown in FIGS. 5 and 6, is removably connected to the base member 102 in sliding relation. The connection means, in the embodiment shown, is effectuated by an upper and lower slot and hook arrangement. FIGS. 4 and 7 show the slot 130 in the base member 102. The slots 130 are cut out of the web 114, which constitutes an outstanding portion, as by punching. Each slot 130 includes an elongate, relatively narrow upper portion 132, a transverse, intermediate, relatively wide portion 134 and a lower, relatively narrow lower portion 136. In the embodiment shown, the three slot cut-out portions 132, 134 and 136 are all connected. FIGS. 4 and 9 show the hook member 140, which is cut out of the web 120 as by punching out upper and lower ell-shaped slots 142 to provide a rectangular tab portion 144. Each tab portion 144 is connected to the body of the cap stop member 104 by a remaining short portion 146. It will be understood that the tab forward portion 144 and rearward portion 146 cooperate to provide the hook member 140, when tab forward portion 144 is bent through 90° about the rearward portion 146.

It is a simple matter to interconnect the upper and lower hook members 140 to their associated upper and lower slots 130 by pushing the tab portion 144 through the upper slot portion 132 and resting connecting portions 146 on the lower margin of the lateral slot portion 134. The portion 146 is slightly shorter than the height of the lateral slot 134 and, because of this, the hook 140 members can be moved transversely in one direction until the cap stop member 104 is in a fully retracted position or moved transversely in the other direction until the cap stop member 104 is in a fully extended positions. In the extended position the hook members 140 can be moved downwardly into slot 136 and thereby into a latched position. The cap stop member 104 can readily by returned to a retracted position by raising it to a position so that it can be moved laterally in the slot portion to the retracted position. The cap stop member can be removed by simply lifting and aligning both hook portions 144 with their associated slot narrow portions 132 and pulling the cap stop member outwardly.

The opposed dividers 100 and 101 are generally similar except that divider 101 is formed in mirror image of divider 100. Also, opposed compartment walls 6 are generally identical in construction. However, as shown in FIG. 3, the lower portion of the wall 6, on one face, has an inclined wall portion 8. A notch 103 is provided in the base member 102 except for wall attached portion 110. This arrangement provides that the base member can readily be bent about the notch 103 to provide an inclined lower portion compatible with inclined wall portion 8.

In order to prevent the cap stop member 104 from being inadvertently removed, a small stop, such a screw 105 shown in FIG. 2 may be removably attached to the inside face of the web portion 114.

It will be understood that there is an advantage in forming the slots and hooks from punched out metal sheet in that no additional parts are required. However, the hook construction could be formed by welded hooks or by the heads of screws.

Although the invention has been described by making detailed reference to preferred embodiments, such detail is to be understood in an instructive rather than in any restrictive sense, many other variants being possible within the scope of the claims hereunto appended.

I claim as my invention.

What is claimed is:

1. A retainer system for a vending machine storage compartment, the retainer system comprising:

a compartment wall;

an elongate retainer including:

a first member attached to the wall and having a portion outstanding from the wall;

a second member, and means for attaching the second member to the first member outstanding portion for movement from a first, retracted position to a second outwardly extended position adapted to engage and intercept a container cap wherein the second member extends from the first member in a cantilevered relationship.

2. A retainer system as defined in claim 1, in which:

the attachment means includes a cutout provided by one of said members and a tab provided by the other of said members and received by the cutout of said one member, said tab being configurated to engagingly connect said first and second members in said first and second positions.

3. A retainer system as defined in claim 1, in which:

said attachment means between the first and second members is provided at two locations in spaced vertical relation.

4. The retainer system as defined in claim 1 wherein the second member is adapted for movement between the first position and the second position with the second member remaining attached to the first member.

5. A retainer system for a vending machine storage compartment, the retainer system comprising:

a compartment wall;

an elongate retainer including:

a first member attached to the wall and having a portion outstanding from the wall;

a second member, means for attaching the second member to the first member outstanding portion for movement from a first, retracted position to a second outwardly extended position adapted to engage and intercept a container cap;

said first member including a slot cutout having a first portion, a second transverse portion disposed below said first portion and a third portion disposed below said second portion and offset from said first portion, said first and third portions communicating with said second portion; and said second member including a tab having a forward portion and a rearward portion smaller than said forward portion whereby said tab is received by said first cutout portion, movable downwardly into engagement with said first member in said retracted position, and moved transversely in said second cutout portion maintaining engagement with said first member into said extended position.

6. The retainer system as defined in claim 5 in which:

said tab forward portion extends above and below said rearward portion.

7. A retainer system for a triple-depth vending machine storage compartment, the retainer system comprising:

opposed compartment walls defining forward, intermediate and rear columns the forward and intermediate columns being adapted to store forwardly arranged bottles;

opposed divider assemblies between the forward, and intermediate columns each assembly including:

a base member attached to a compartment wall and having portion outstanding from the wall including a slot, and a cap stop member including a hook receivable by the slot in movable relation for movement of the cap stop member from a retracted position to an extended position in which the cap stop member is engageable by the cap of a bottle in the intermediate column.

8. A retainer system as defined in claim 7 wherein:

the hook includes upper and lower portion forward portion and a rearward portion.

9. A retainer system as defined in claim 8 wherein:

the slot includes upper, intermediate and lower portions, said intermediate portion being wider than the hook intermediate portion so that the hook can be moved transversely in said intermediate portion.

10. A retainer system as defined in claim 8 wherein:

the slot includes upper and lower portions disposed respectively above and below the transverse portion, said hook intermediate portion being moved downwardly into a latched position within said lower portion.

* * * * *